US008708882B2

(12) United States Patent
Chan et al.

(10) Patent No.: US 8,708,882 B2
(45) Date of Patent: Apr. 29, 2014

(54) APPARATUS FOR PRODUCING CUSHIONING MATERIAL

(75) Inventors: Simon C. S. Chan, Kirkland, WA (US); Jiang Wen Yong, Guangzhou (CN)

(73) Assignee: Nuevopak Technology Company Limited, Kwun Tong, Kowloon (HK)

( * ) Notice: Subject to any disclaimer, the term of this patent is extended or adjusted under 35 U.S.C. 154(b) by 192 days.

(21) Appl. No.: 13/107,857

(22) Filed: May 13, 2011

(65) Prior Publication Data

US 2011/0281711 A1 Nov. 17, 2011

Related U.S. Application Data

(60) Provisional application No. 61/334,507, filed on May 13, 2010, provisional application No. 61/347,457, filed on May 24, 2010.

(51) Int. Cl.
*B31B 1/00* (2006.01)

(52) U.S. Cl.
USPC ..... 493/464; 493/407; 493/967

(58) Field of Classification Search
USPC ..... 493/407, 464, 967; 53/439
See application file for complete search history.

(56) References Cited

U.S. PATENT DOCUMENTS

| | | | | |
|---|---|---|---|---|
| 5,439,730 | A * | 8/1995 | Kelly et al. | 428/156 |
| 6,017,299 | A * | 1/2000 | Ratzel | 493/464 |
| 7,004,413 | B2 * | 2/2006 | Langlois | 241/242 |
| 2004/0217223 | A1 * | 11/2004 | Langlois | 241/294 |
| 2008/0076654 | A1 | 3/2008 | Riga et al. | |

* cited by examiner

*Primary Examiner* — Hemant M Desai
(74) *Attorney, Agent, or Firm* — DWC Law Firm, P.S.; David Chen

(57) ABSTRACT

A dunnage machine and system, and a method of producing dunnage. The dunnage machine can have rotatable forming members with recesses formed thereon. Stationary protruding members can extend into the recesses. A cutting system is provided for cutting dunnage produced by the dunnage machine or system, and a lock mechanism is also provided for locking the cutting system when a cover is removed from the dunnage machine.

15 Claims, 20 Drawing Sheets

APPARATUS FOR PRODUCING CUSHIONING MATERIAL

CROSS REFERENCE TO RELATED APPLICATION(S)

This application claims the benefit of U.S. provisional patent application Ser. No. 61/334,507 and U.S. provisional patent application Ser. No. 61/347,457, filed May 13, 2010 and May 24, 2010, respectively, both of which are incorporated herein by reference in their entireties.

BACKGROUND

1. Technical Field

The present disclosure relates to apparatus, systems, and methods for producing materials used to fill voids in containers and packages.

2. Description of Related Art

US Patent Application Pub. No. 20090258775 (also entitled "Apparatus, Systems and Methods for Producing Cushioning Material"), discloses a dunnage machine, or system, for use in producing cushioning material, and is hereby incorporated herein by reference in its entirety. The system disclosed in that application comprises a motor that drives a plurality of forming members. Each of the forming members has fins for use in crumpling sheet material and pulling the sheet material through the system to form cushioning material.

As the forming members pull the sheet material from a feed system, each portion of the sheet material can pass through a funnel-like passageway with converging sidewalls before reaching the forming members. The sheet material can thus be fed to the system and be laterally folded, rolled or compressed as it passes through the funnel-like passageway to decrease a horizontal width of the sheet material. After being laterally folded, the sheet material reaches the forming members where it is vertically compressed or crumpled by passing between the horizontally aligned forming members, as the fins of the forming members impact the sheet material from above and below the sheet material. Cushioning product, or cushioning material, is thus generated.

Although forming members, such as those disclosed in US Pat. App. Pub, No. 20090258775, are effective in generating cushioning material, on some occasions, the cushioning material can "jam" or be caught near an outlet or exit region of the forming members. Without being bound by theory, it is believed that since the movement and configuration of the cushioning material has some random characteristics near the exit region of the forming members, in some circumstances, the cushioning material can momentarily accumulate at the exit region, which is a confined passageway. When such accumulation occurs, movement of further incoming cushioning material can be restricted, causing the cushioning material to pack and sometimes "jam." In such cases, an operator typically releases the "jam" by manually removing the packed cushioning material from the exit region.

In addition, as cushioning material is generated and leaves the exit region of the dunnage machine, it can be cut to a desired length, either automatically or manually. One way in which the cushioning material can be cut is by mounting a blade near an exit region of the dunnage machine. An operator can grab an end of the cushioning material and force it across the fixed blade edge. Although such a fixed-blade cutter can, or leveraged manual cutters that move blades using manual force, can provide cost advantages over automated cutters operated by motors, physical exertion of the operator can contribute to fatigue.

BRIEF SUMMARY OF THE INVENTION

In some embodiments of the present disclosure, a dunnage machine is provided having rotatable forming members. The forming members can be formed with circumferential recesses that extend about a circumference of the forming members. An exit chute can be mated with the forming members, through which dunnage is dispensed from the forming members. The exit chute can comprise protruding tongues or members that extend into the recesses.

In some embodiments of the present disclosure, a dunnage machine can be equipped with a manually operated cutter. The cutter can comprise elongated frame members that are pivotable about one end thereof. A handle surface can extend between the elongated frame members near a distal end portion of the elongated frame members. The handle surface can be planar and can be wide in comparison with a maximum width of the elongated frame members. The handle can be depressed to actuate a cutting operation, descending a blade against dunnage material dispensed from the exit chute. When the handle is no longer depressed, a biasing member can act on the elongated frame members to return the handle surface to a resting position. The resting position of the handle can be proximate, or near, an exit region of the dunnage machine. In some embodiments, the resting position of the handle is forward of the dunnage machine, and proximate an exit opening of the dunnage machine.

Also, a lock mechanism can be provided for the cutter, which can also lock a cover of the dunnage machine when the cutter is operable. For example, biasing members can be connected to pivot arms, wherein when the pivot arms are pivoted to a downward position, the biasing members bias a catch member toward a cross member that is fixedly attached to the elongated frame members. Catch tabs on the catch member can couple with the cross member, to lock the elongated frame members from being depressed, thereby locking the blade so that I cannot be operated. Also, when the pivot arms are pivoted to an upward position, the biasing member can bias the catch member against a cover of the dunnage machine to lock an otherwise removable cover on the dunnage machine from being removed when the cutter is being operated, which can provide extra safeguards for an operator (provided that proper procedures are otherwise followed).

DETAILED DESCRIPTION

In the following description, certain specific details are set forth in order to provide a thorough understanding of various embodiments of this disclosure. However, upon reviewing this disclosure one skilled in the art will understand that the invention may be practiced without many of these details. In other instances, well-known or widely available machine parts (such as, for example, drive-belts, gears and motor parts) have not been described in detail to avoid unnecessarily obscuring the descriptions of the embodiments of the present disclosure.

Various embodiments of the present disclosure are described for purposes of illustration, in the context of use with paper-based sheet materials for dunnage formation. However, as those skilled in the art will appreciate upon reviewing this disclosure, other materials may also be suitable.

Figure 1A:
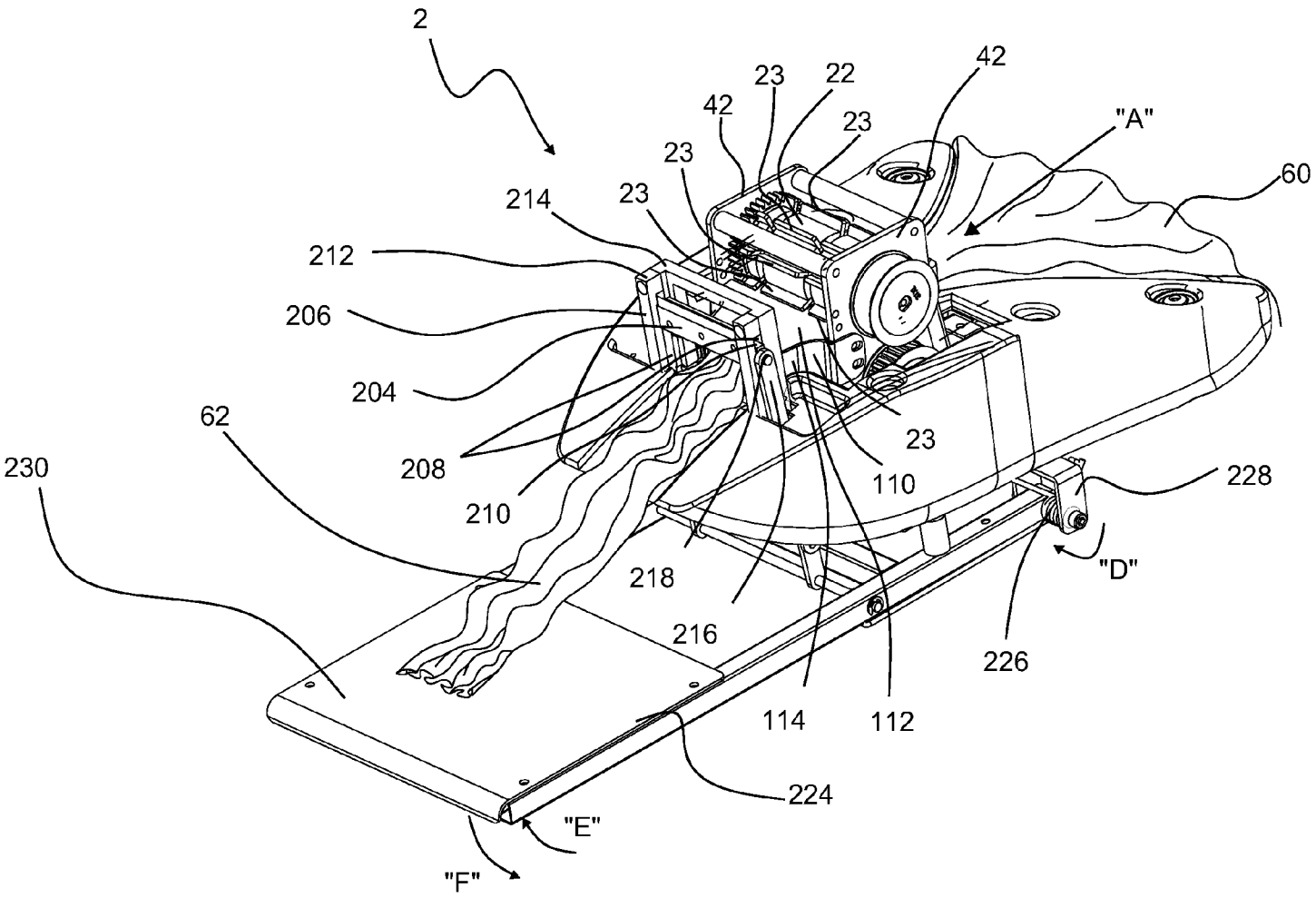
FIG. 1A is a perspective view of a dunnage machine for an embodiment of the present disclosure, with a top cover portion of the dunnage machine removed for purposes of illustration.
Figure 1B:
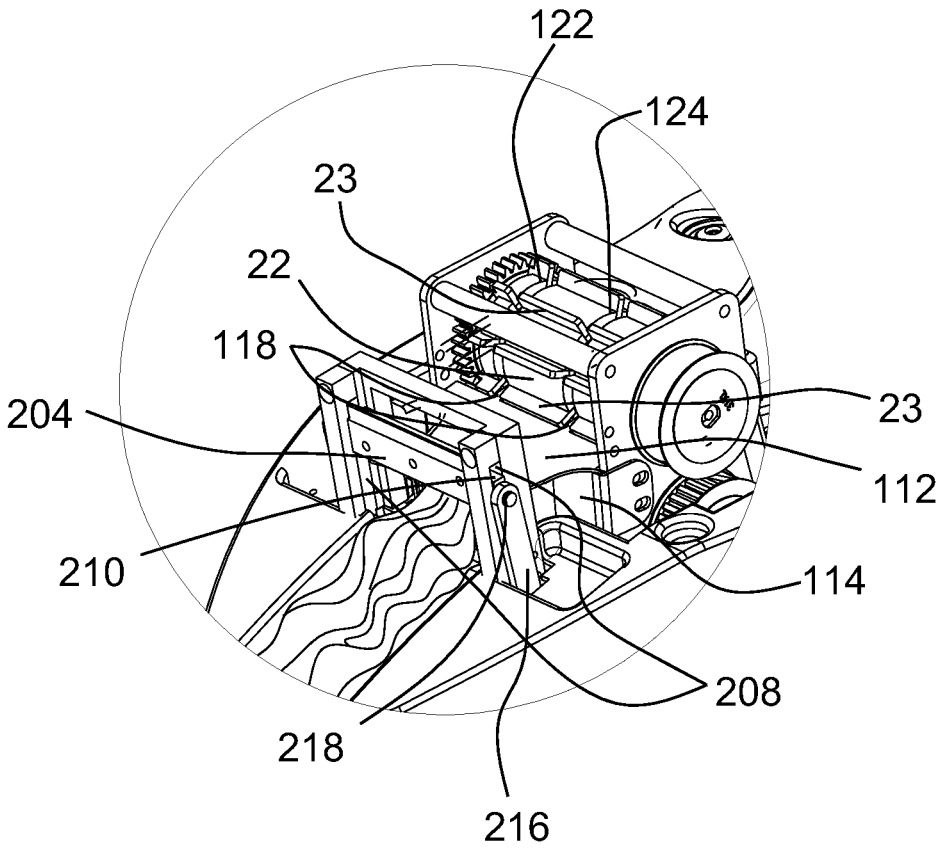
FIG. 1B is an enlarged perspective view of an upper forming member, exit chute and blade mount of the dunnage machine as shown in FIG. 1A.
Figure 2A:
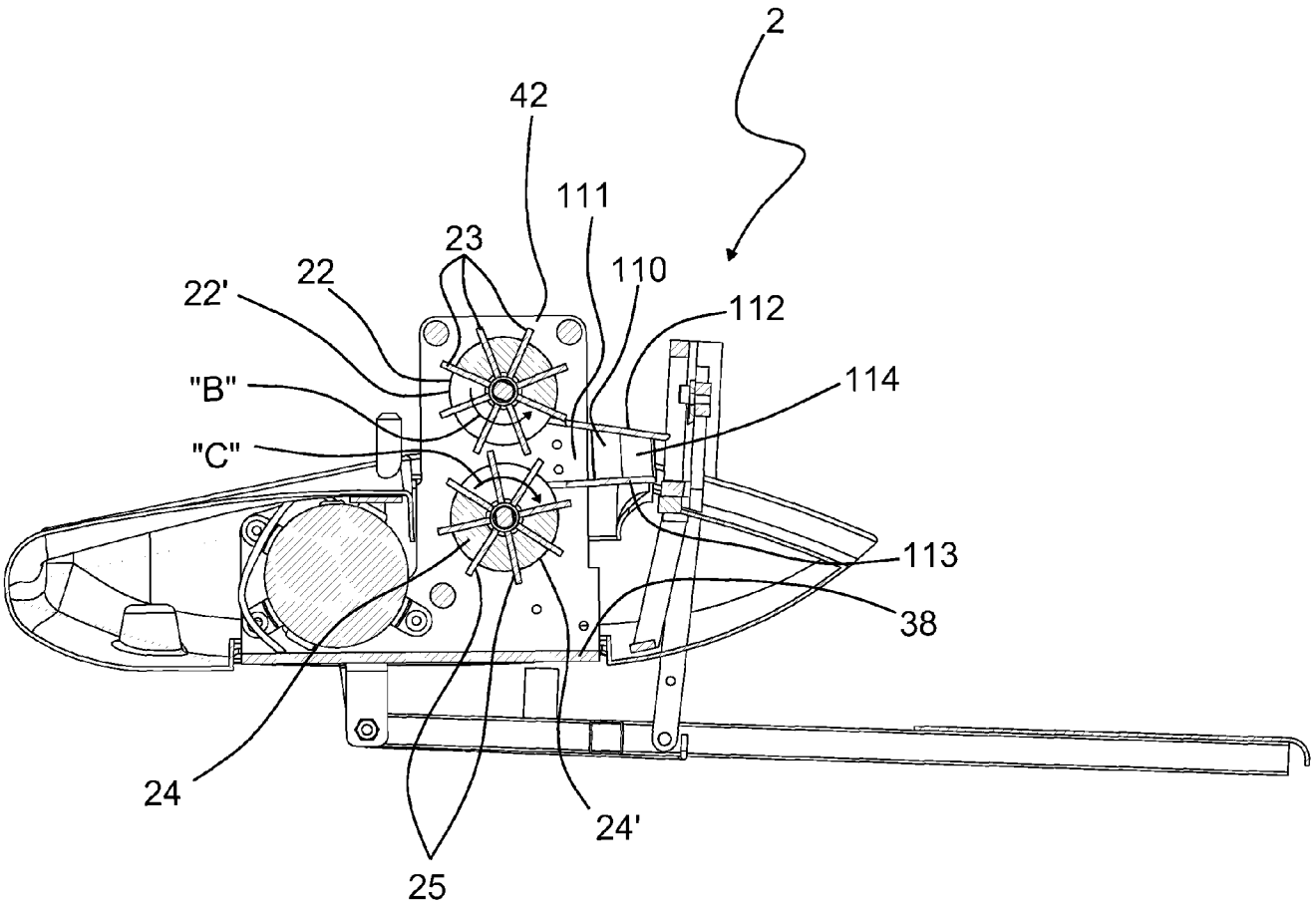
FIG. 2A is a cross sectional side view of the dunnage machine of FIG. 1A.

Referring to FIGS. 1A, 1B & 2A, in some embodiments of the present disclosure, a dunnage machine 2 is provided having two forming members 22, 24. The forming members can include an upper forming member 22, and a lower forming member 24, and the forming members can be horizontally axially aligned. Additionally, a base plate 38 can be provided having mounting plates 42 attached thereto. The mounting plates 42 can be fixedly attached to the base plate 38 and can extend in substantially vertical fashion upward from the base plate 38. The upper and lower forming members 22, 24 can be rotatably attached to the mounting plates 42.

As illustrated in FIGS. 1A, 1B & 2A, each of the forming members 22, 24 can have fin members 23, 25. The forming members 22, 24 can be positioned in connection with a motor driving gear assembly (not illustrated) of the present embodiment, such that the respective fin members do not collide during rotation. That is, for example, when the forming members rotate, the positions of the fins on the relative forming members are off-set in phase (See, e.g., FIG. 2A). When sheet material 60 is fed to the forming members 22, 24 in the direction of arrow "A" (See, e.g., FIG. 1A), the dunnage machine 2 can be operated to cause the forming members 22, 24 to rotate in the directions of arrows "B" and "C" (See, e.g., FIG. 2A). The forming members 22, 24 interactively process the sheet material to crumple it and to pull the sheet material in direction "A" to feed it through the dunnage machine 2. The fin members 23, 25 can perform the functions of forming and pulling the sheet material through the dunnage machine 2 for continuous processing.

Referring to FIGS. 1A, 1B, 2A, 3, 4 and 7A-C, in some embodiments of the present disclosure, an exit chute 110 is provided having a top wall 112, bottom wall 113, and side walls 114 to provide a guide for the cushioning material 62 in the exit region 111 (See, e.g., FIG. 2A), immediately downstream of the forming members 22, 24. The sidewalls 114 of the chute 110 define the lateral boundaries of an exit region 111 (See, e.g., FIGS. 2A, 3, 4 and 7A-C) for the cushioning material 62 that exits from the forming members 22, 24. The top wall 112 and bottom wall 113 can define the upper and lower vertical boundaries of the exit region 111 (See, e.g., FIGS. 1A, 2A, 7B & 7C), for the cushioning material 62 exiting the forming members 22, 24.

In some embodiments, the side walls 114 of the exit chute 110 can be attached to the respective mounting plates 42 of the dunnage machine 2 (See, e.g., FIGS. 1A, 3 & 4) so as to, in combination with the mounting plates 42, completely define the lateral boundaries of the cushioning material 62 in the exit region 111 near the forming members 22, 24.

Figure 5:
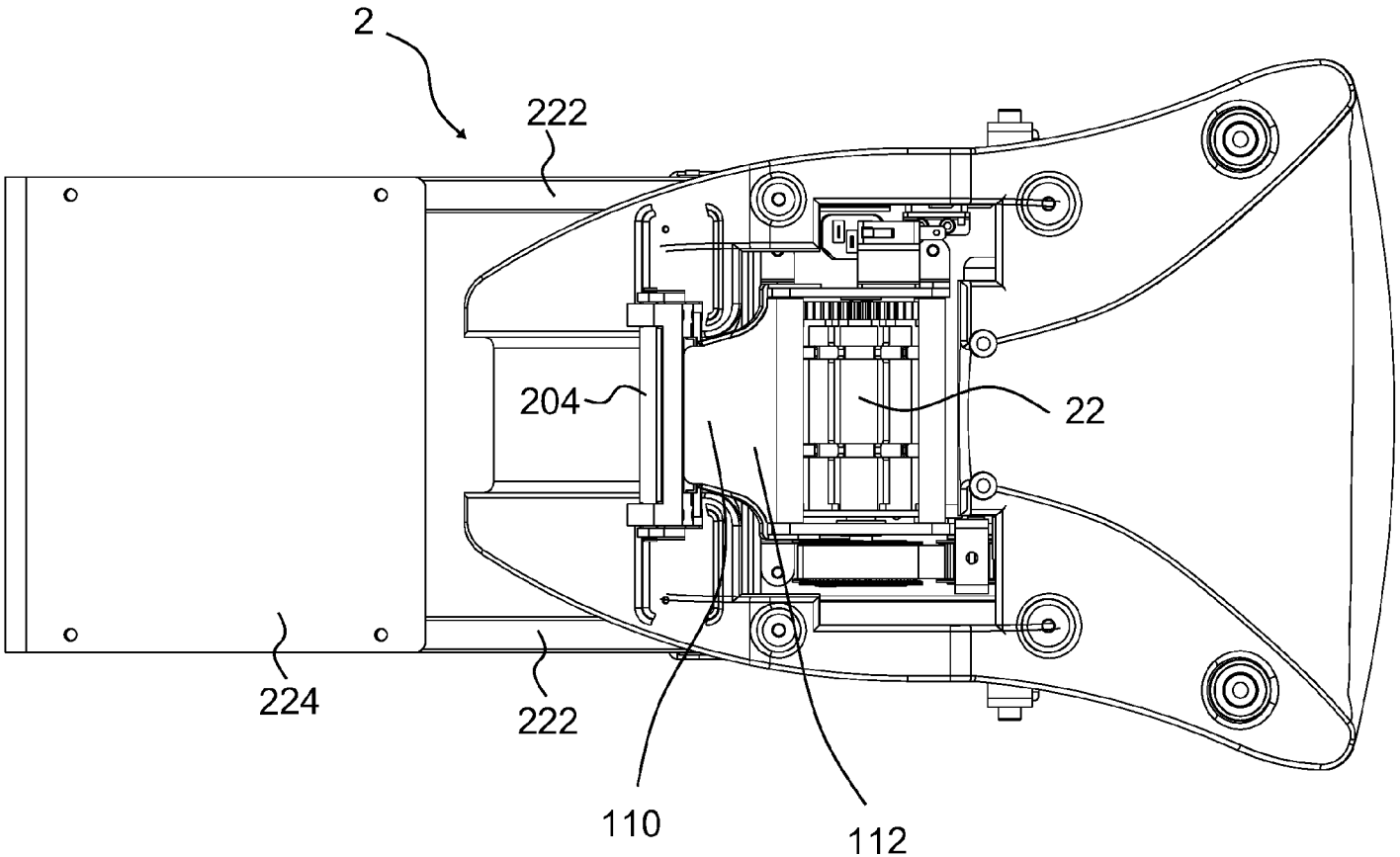
FIG. 5 is a top plan view of the dunnage machine as illustrated in FIG. 1.
Figure 6A:
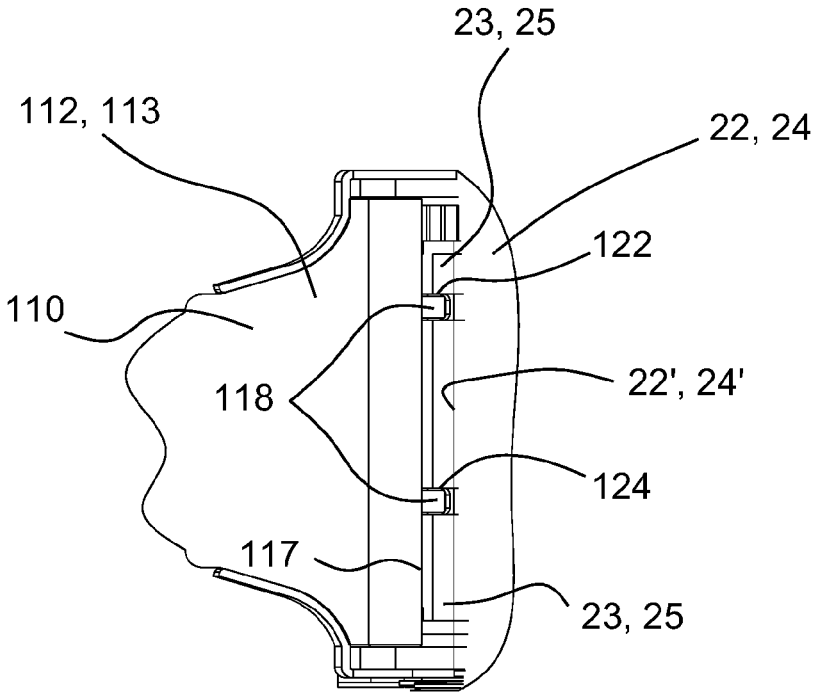
FIG. 6A is a simplified plan view of a top wall or bottom wail of an exit chute of an embodiment of the present disclosure combined with a cutaway plan view of a forming member, with the exit chute disposed in mated fashion with the forming member as it is intended to be installed in some embodiments of the present disclosure.
Figure 6B:
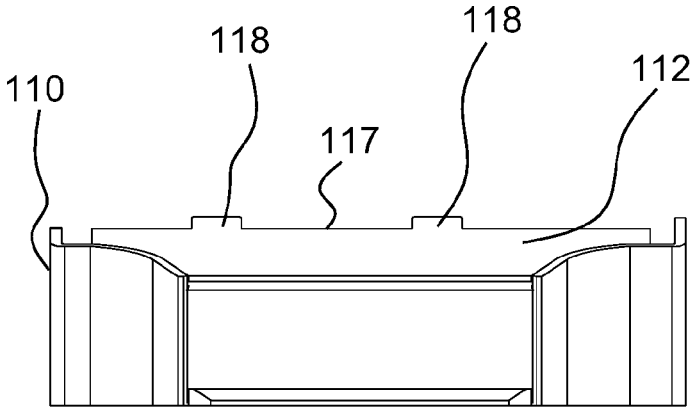
FIG. 6B is a front elevation view of an embodiment of the exit chute of the present disclosure.
Figure 6C:
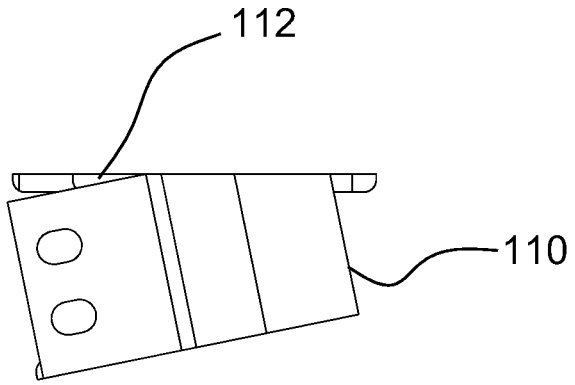
FIG. 6C is a side elevation view of an embodiment of the exit chute of the present disclosure.
Figure 6D:
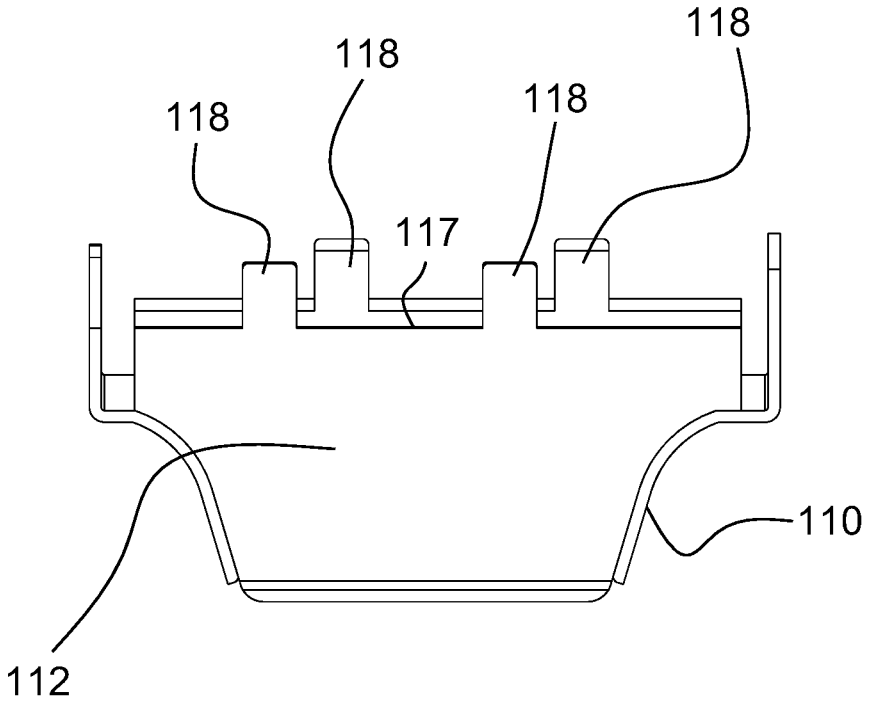
FIG. 6D is a top plan view of an embodiment of the exit chute of the present disclosure.
Figure 6E:
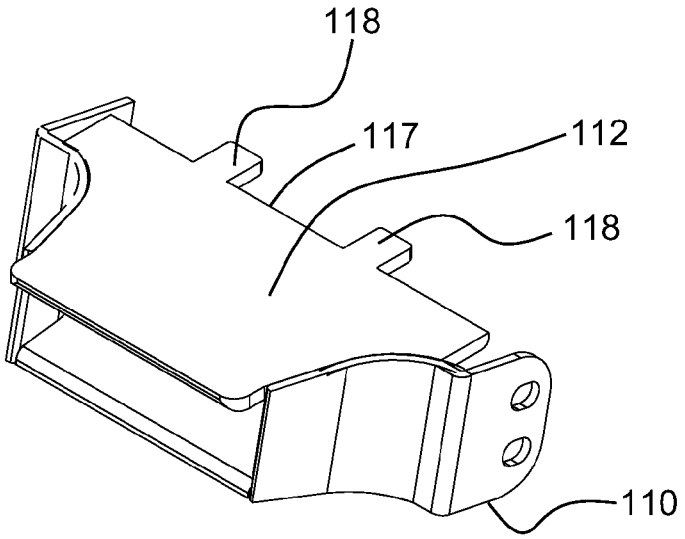
FIG. 6E is a top perspective view of an embodiment of the exit chute of the present disclosure.
Figure 6F:
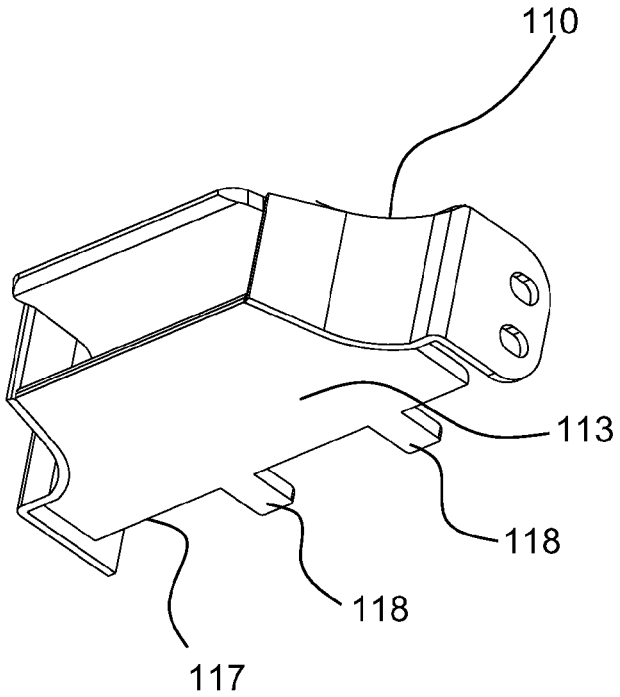
FIG. 6F is a bottom perspective view of an embodiment of the exit chute of the present disclosure.
Figure 7A:
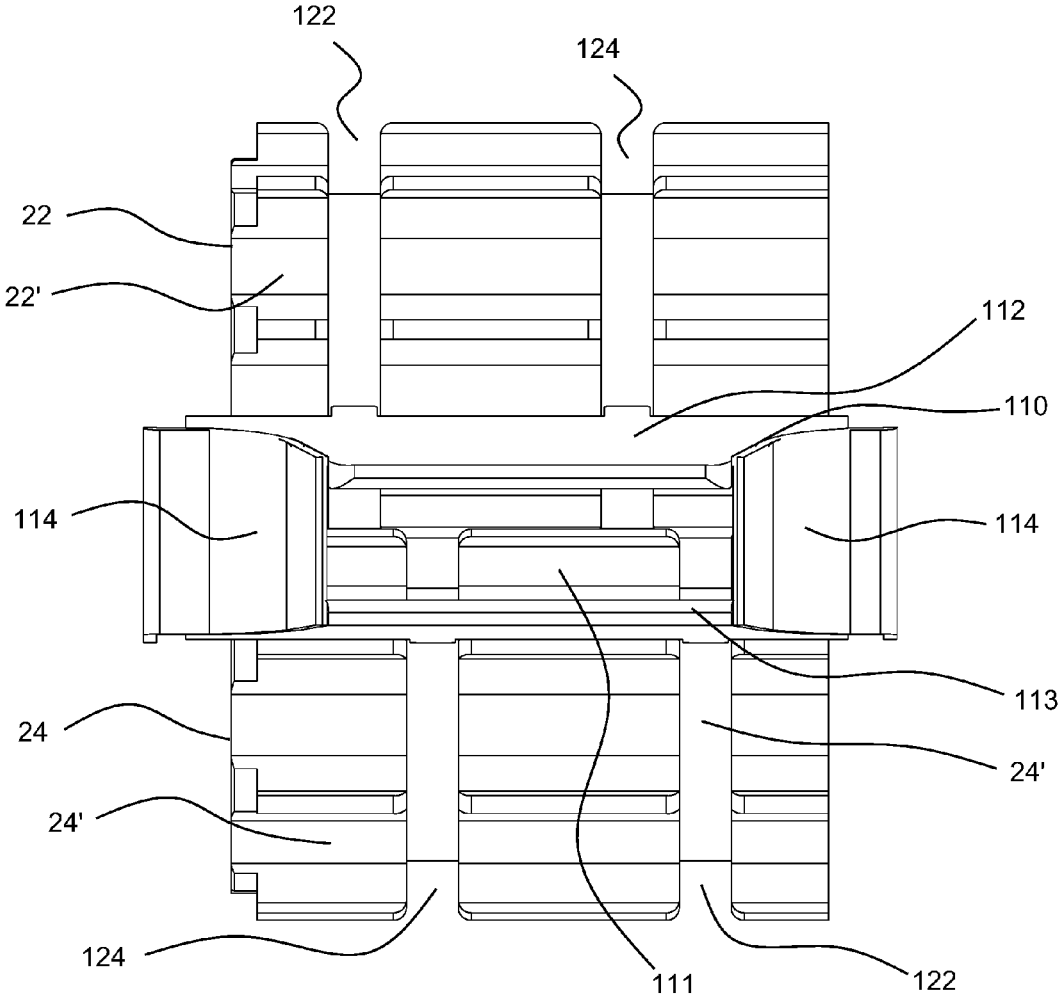
FIG. 7A is a front elevation view of an embodiment of an exit chute disposed in mated fashion with an embodiments of the forming members of the present disclosure.
Figure 7B:
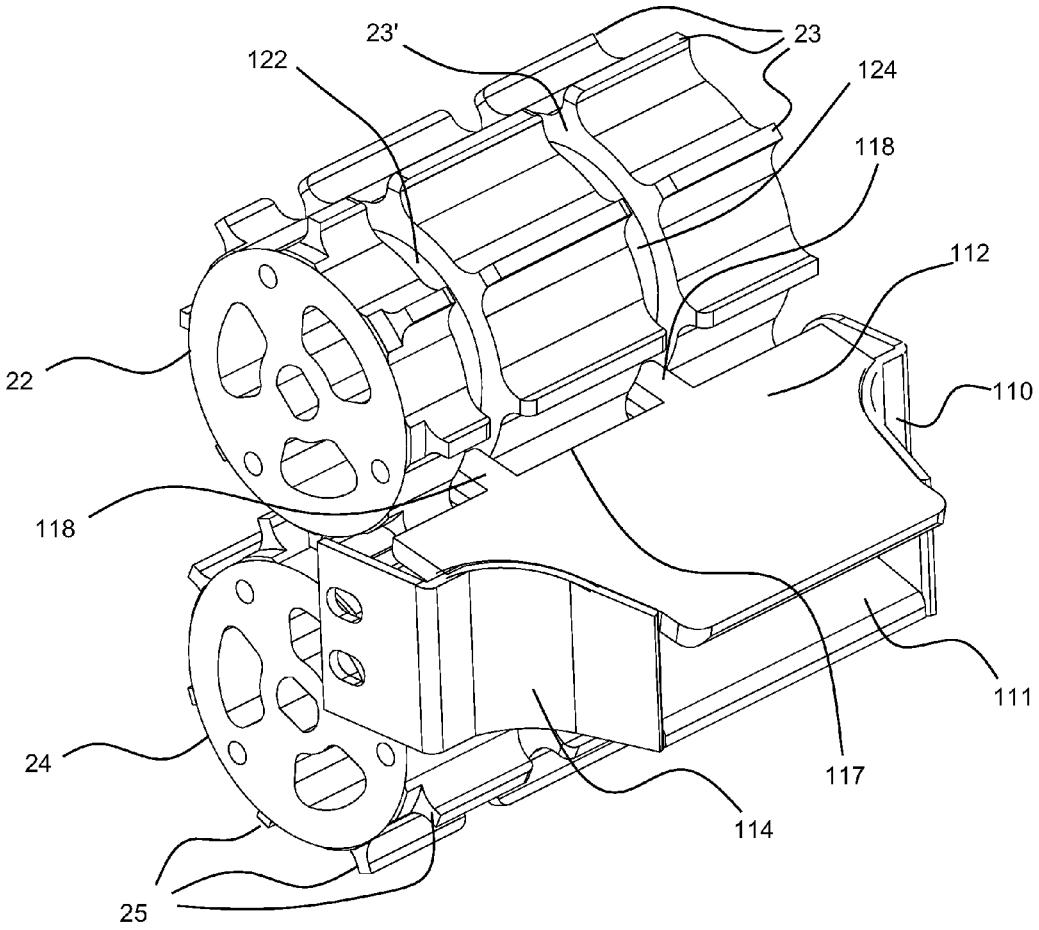
FIG. 7B is a top perspective view of an embodiment of an exit chute disposed in mated fashion with an embodiment of the forming members of the present disclosure.
Figure 7C:
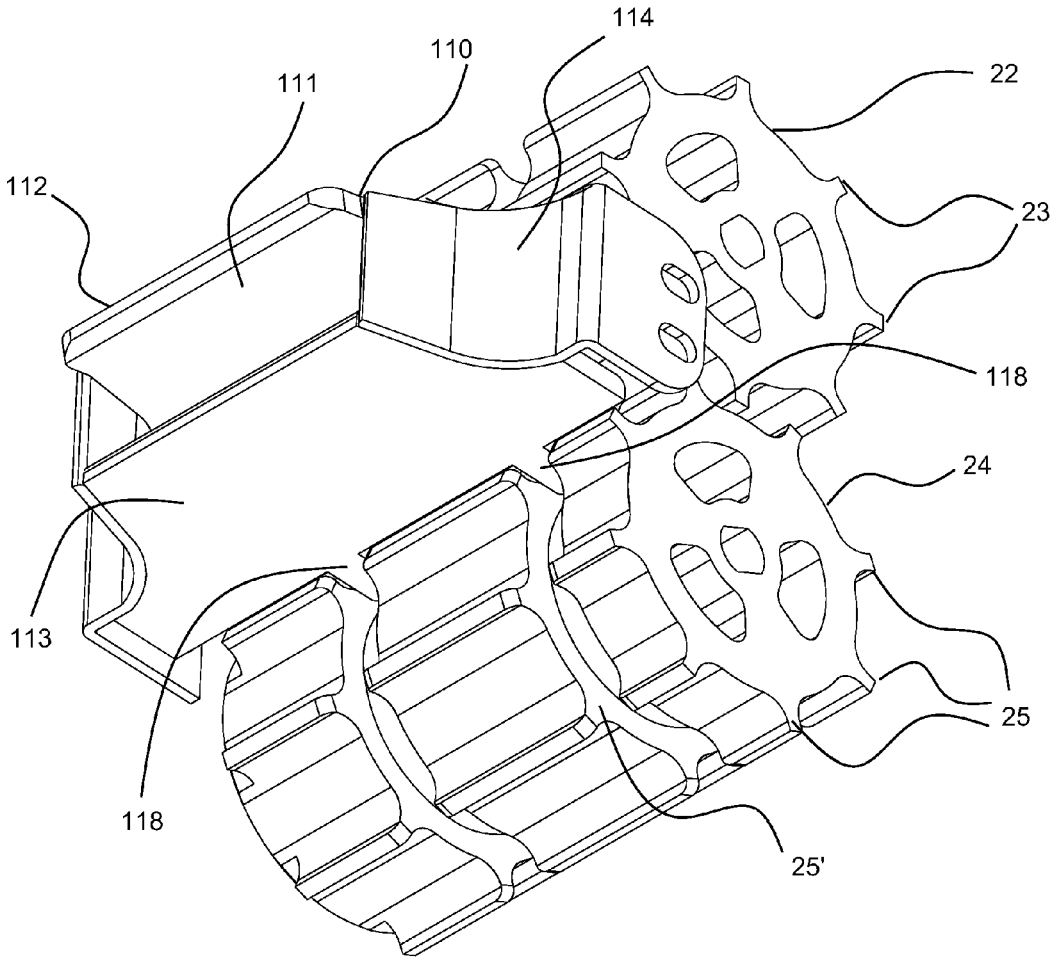
FIG. 7C is a bottom perspective view of the exit chute and members in FIG. 7B.

In some embodiments, both the top wall 112 and the bottom wall 113 are laterally wider near the forming members 22, 24 with the lateral edges of the walls 112, 113 being closer together further from the forming members 22, 24, as best seen in FIGS. 5, 7B and 7C. The bottom wall 113 can have generally the same configuration as the top wall 112.

Figure 2B:
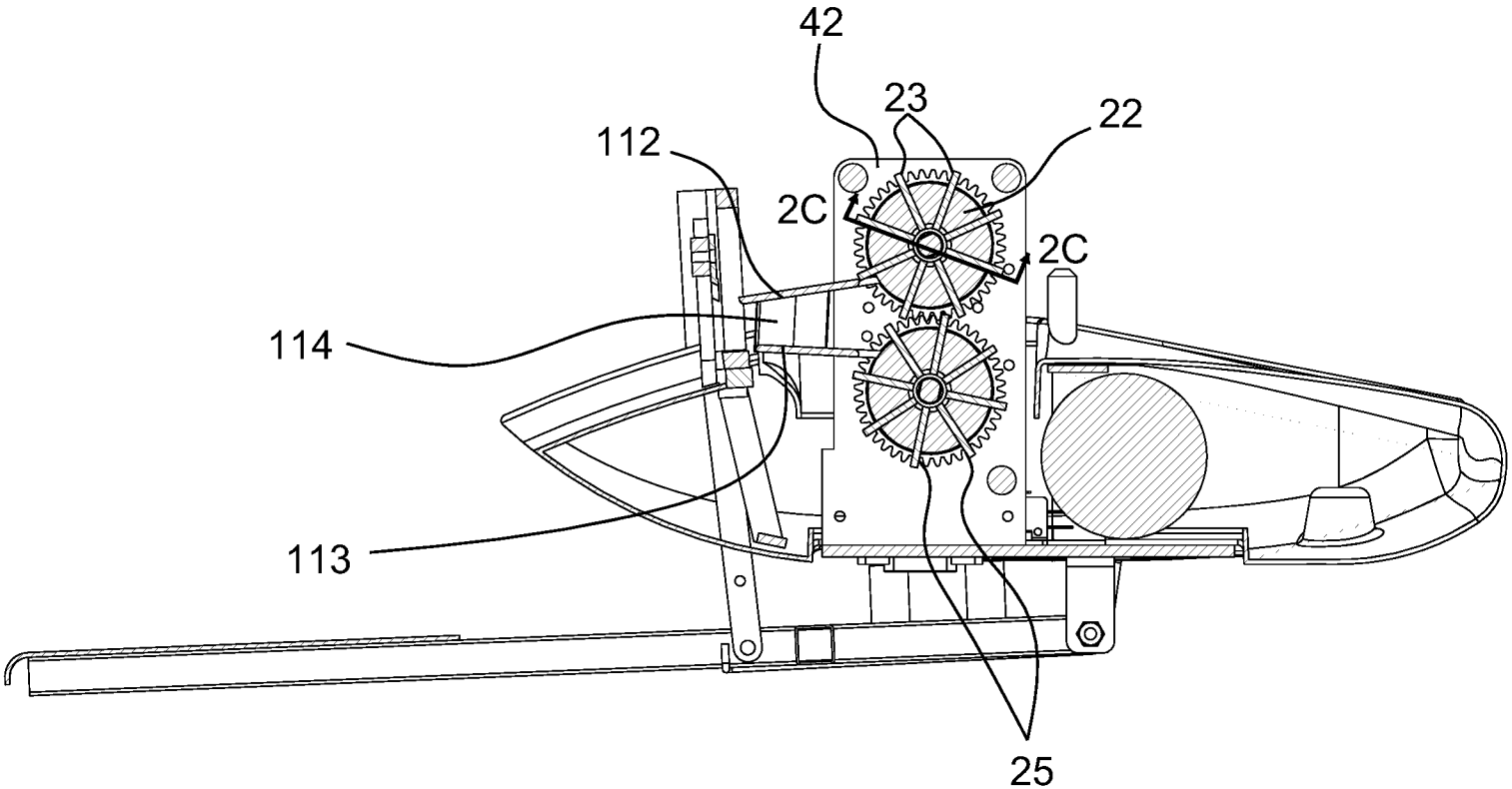
FIG. 2B is a cross sectional side view of the dunnage machine of FIG. 1A, as viewed from an opposite side from FIG. 2A.
Figure 2C:
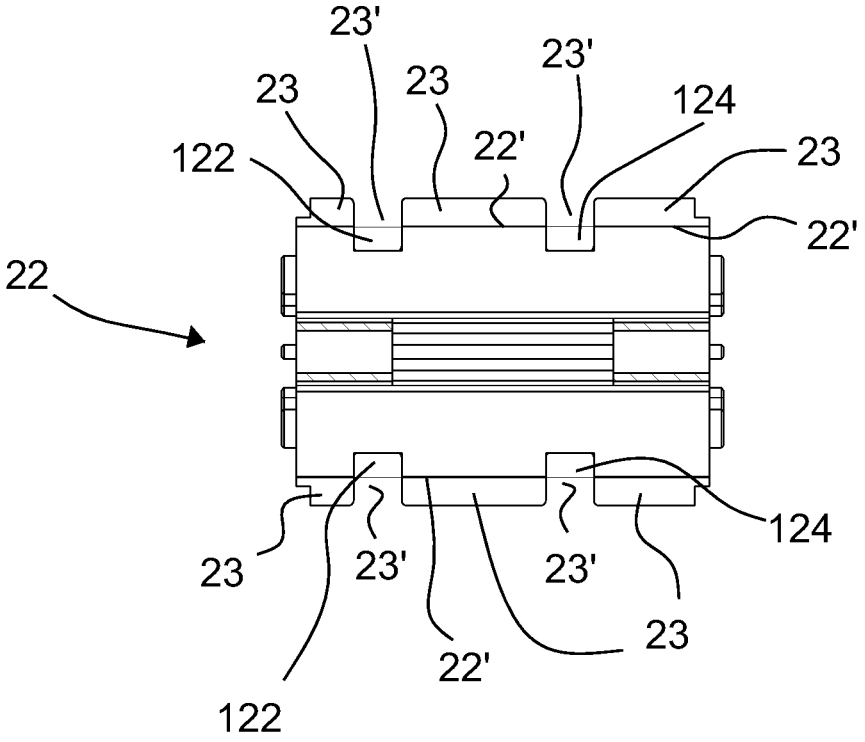
FIG. 2C is a cutaway lateral cross sectional view of a forming member shown in FIG. 2B, as viewed from line 2C-2C in FIG. 2B.
Figure 3:
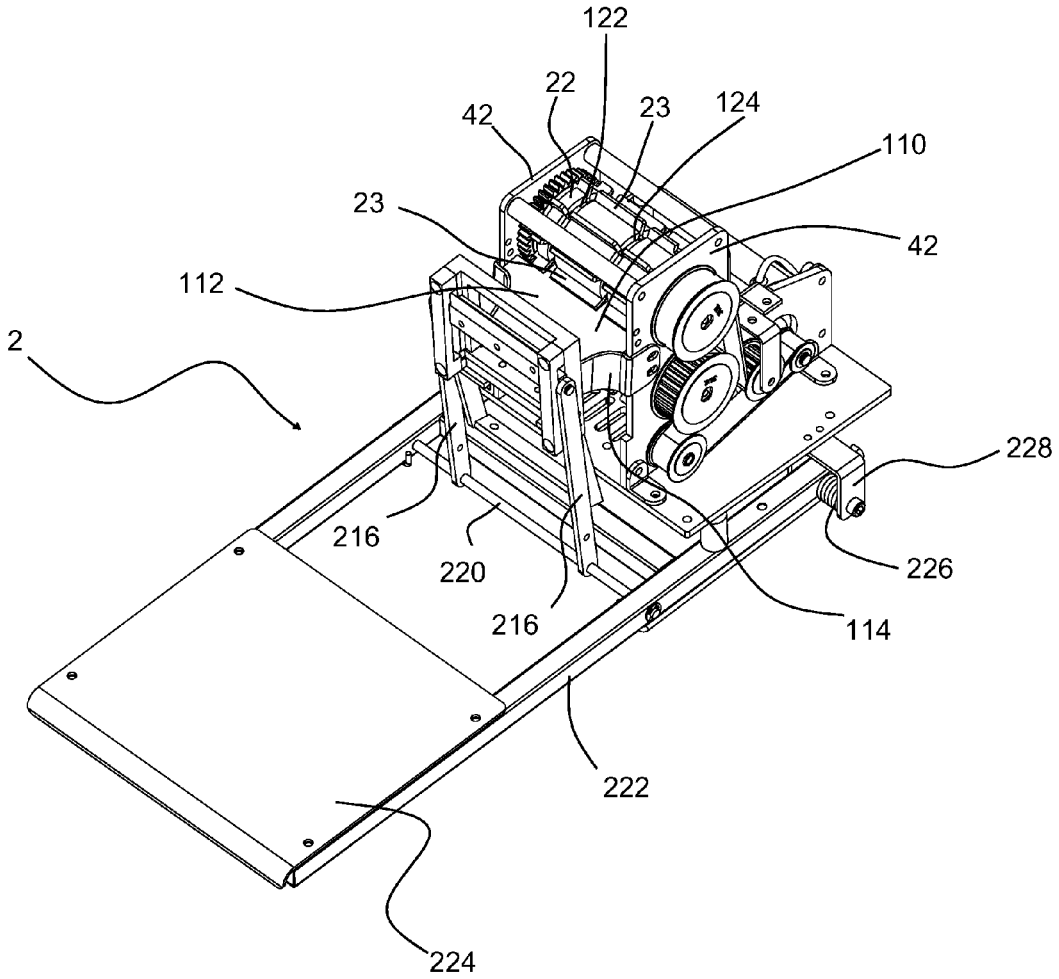
FIG. 3 is a perspective view of the dunnage machine of FIG. 1, with both a top cover portion and a bottom cover portion of the dunnage machine removed for purposes of illustration.
Figure 4:
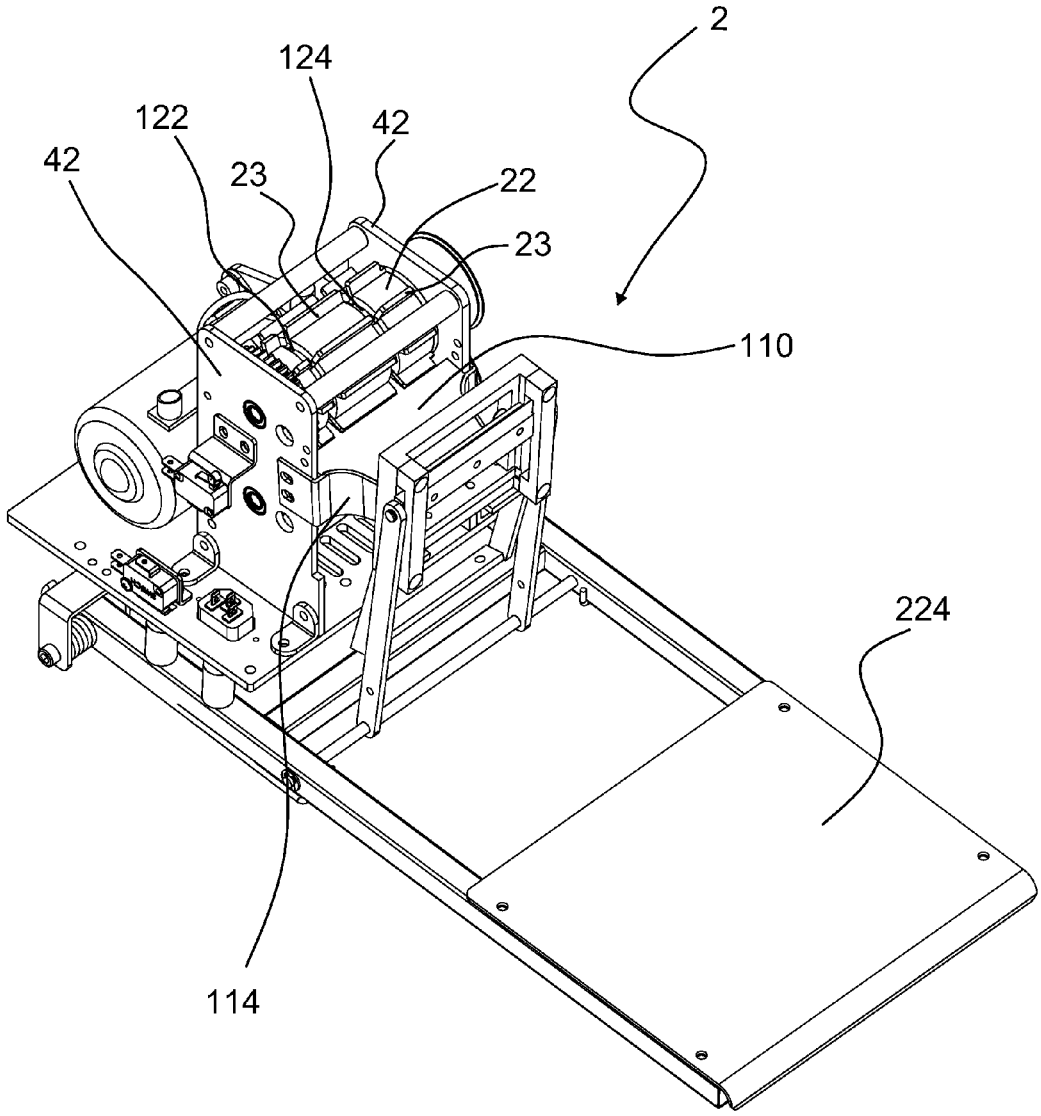
FIG. 4 is a perspective view of the dunnage machine of FIG. 3, as viewed from an angle that is rotated about 90 degrees horizontally from FIG. 3.

As can be seen in FIGS. 7A & 7B, in some embodiments of the present disclosure, both the upper forming member 22 and lower forming member 24 each have two circumferential recesses 122, 124. In FIGS. 1B, 3 & 4, the circumferential recesses 122, 124 are only shown for upper forming member 22, however, the lower forming member 24 can have the same or substantially similar circumferential recesses 122, 124. The circumferential recesses 122, 124 can extend about a circumference of the forming members 22, 24. FIG. 2C illustrates a cut-away cross sectional view of the upper forming member 22, shown along line 2C-2C of FIG. 2B, wherein each of the circumferential recesses 122, 124 can have a sectional contour that is rectangular in shape at a radially inner end portion thereof. This can also be seen in FIG. 7A. Also, each fin 23 of the upper forming member 22 can be "cut-out" or include a gap 23' above each circumferential recess 122, 124, to fully expose the corresponding circumferential recess 122, 124. Each circumferential recess 122, 124 thus not only extends radially inward through the fins 23, but also past the surface 22' of the forming member 22. The tins 25 of the lower forming member 24 can be provided with the same, or substantially similar, structure as the fins 23 of the upper forming member 22, with corresponding gaps provided in the fins 25 above the circumferential recesses 122, 124 located on the lower forming member 24.

As best seen in FIGS. 6A-6F and 7A-C, in some embodiments of the present disclosure, both the top wall 112 and the bottom wall 113 of the chute 110 can be formed with lateral protruding strips or tongues 118, that can be positioned on the same plane as the walls 112, 113, and can protrude inward from an inward edge 117 of each wall 112, 113, to extend into the circumferential recesses 122, 124 of the forming members 22, 24. If the fins 23, 25 are partially aligned with the tongues 118, due to rotation of the forming members 22, 24 (such as is also shown, for example, in FIGS. 1B and 7A-C), the tongues 118 can extend through the gaps on the fins 23, 25, such as the gaps 23' shown in FIG. 2C, o gaps 25' in FIG. 7C, can extend radially inward past the surfaces 22', 24' of the forming members 22, 24 (See e.g., FIG. 7B). The tongues 118 can have a rectangular shape to fit within the gaps of the fins 23, 25 and the circumferential recesses 122, 124, such that the edges of the tongues 118 can be disposed in close proximity to the inside walls of the gaps 23', 25' and circumferential recesses 122, 124.

The inwardly extending tongues 118 of the top wall 112 and bottom wall 113 of the chute 110 can help reduce any potential jamming of the cushioning material 62 at the exit region 111 of the dunnage machine 2. Without being bound by theory, the inventors hereof believe that reduced jamming tendency that can be imparted by the embodiments of the present invention is, in part, due to the fact that the sheet material 60 of the present disclosure, encounters the inside surface of the tongues 118 even while the sheet material is still between the forming members 22, 24. In other words, the tongues 118 help guide the direction of movement of the cushioning material 62 toward the exit region 111 before the cushioning material 62 even fully exits past the forming members 22, 24.

Figure 8:
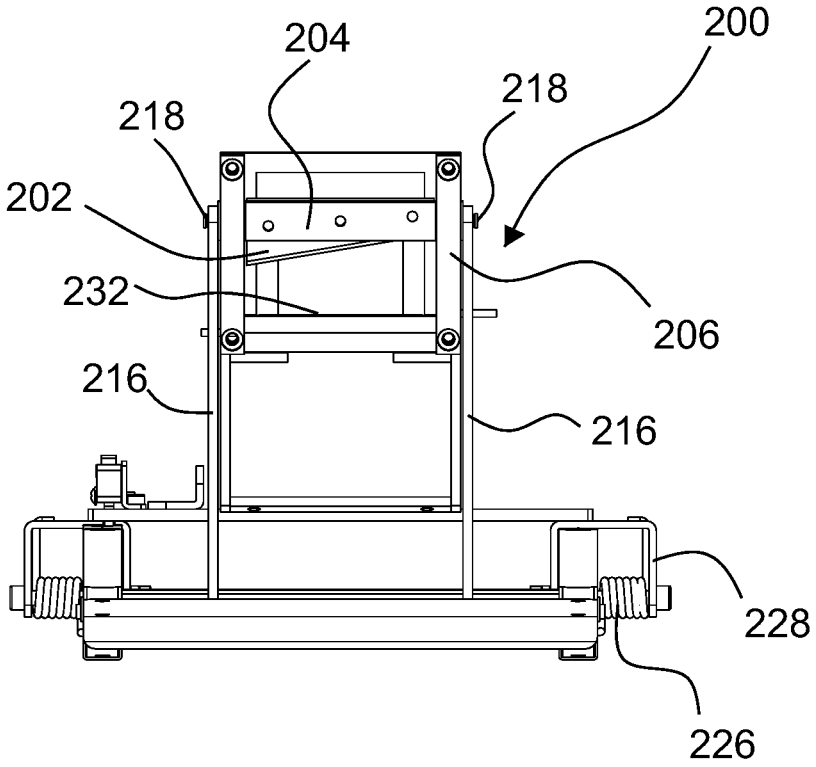
FIG. 8 is a front elevation view of an embodiment of a cutter of the present disclosure.
Figure 9:
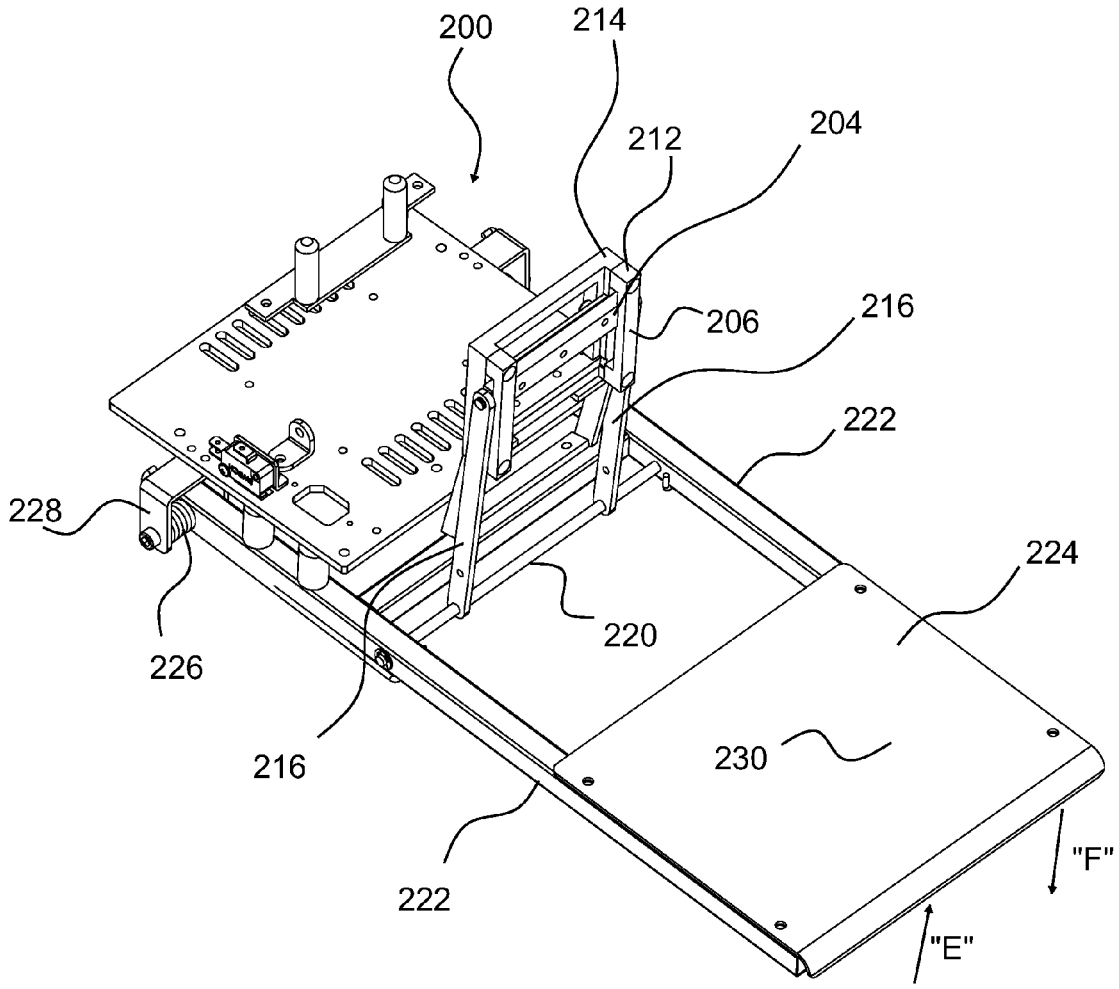
FIG. 9 is a top perspective view the cutter of FIG. 8.
Figure 10:
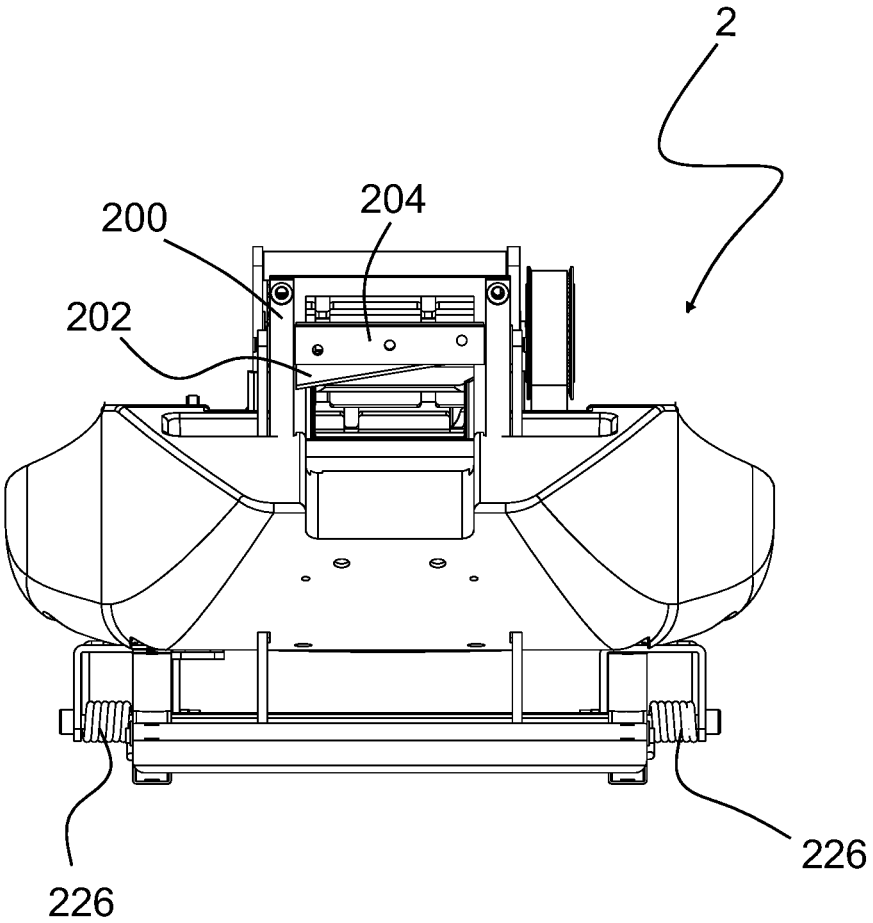
FIG. 10 is a front elevation view of the cutter of FIG. 8 installed on an embodiment of a dunnage machine of the present disclosure.

As best seen in FIGS. 8 and 9, in some embodiments of the present disclosure, a cutter 200 is provided having blade 202, connected to a blade mount 204. FIG. 10 illustrates the cutter 200 as installed on a dunnage machine 2 embodiment of the present disclosure, with a top cover of the dunnage machine removed so that the blade is visible.

Referring to FIGS. 1A, 1B and 8-10, the blade mount 204 is connected to a slider bar 210, which is slidably attached to a track 206. Referring to FIGS. 1A & 1B, each of the two end portions of the slider bar 210 are disposed within a generally vertically aligned slit 208, with the two slits 208 each being formed between a first track portion 212 and second track portion 21.

Still referring to FIGS. 1A, 1B and 8-10, two cutter arms 216 are provided, with top end portions of the cutter arms 216 being pivotably connected to opposite end portions of the slider bar 210, via pivotable connectors 218. As best seen in FIGS. 3 and 9, bottom end portions of the cutter arms 216 are pivotably connected to a lateral bar 220, or lateral member, with the lateral bar 220 being fixedly attached at each end to an elongated frame member 222 of a handle structure 224. The elongated frame members 222 can be disposed in parallel alignment with one another, and can each be povitably connected to a fixed point 228 (relative to the dunnage machine 2) at a rear end portion of the frame members 222. A coil spring 226 can also being attached to each of the elongated frame members 222, proximate the fixed point 228 to which the frame members 222 are pivotably connected. The coil springs 226 can bias the frame members 222 in the rotational direction illustrated by arrow "D" in FIG. 1A.

Referring to FIGS. 1A and 9, as will be appreciated by those skilled in the art after reviewing this disclosure, when a user (operator) presses a surface 230 of handle structure 224 downward, to bias an end portion of the handle structure downward in the direction of arrow "F," the elongated frame members 222 pivot generally in the direction of arrow "F," thus causing the cutter arms 216 to descend, pulling the blade 202 downward. The blade 202 then can descend until it comes into contact with cushioning material 62 below the blade 202, to force the cushioning material against a lower surface 232 (See, e.g., FIG. 8), to cut the cushioning material. Referring back to FIG. 1A, when the operator releases the handle structure 224, the coil spring 226 biases the elongated frame members 222 in the direction of arrow "D," opposite to the direction in which the operator pressed to achieve the cut, and the blade 202 can thus ascend automatically to reset into a ready position, or resting position, above the cushioning material 62 so that the cushioning material 62 can again pass under the blade 202.

As will be appreciated by those skilled in the art after reviewing this disclosure, the position of the surface 230 of the handle structure 224 is positioned past an end portion of the dunnage machine 2, forward of a dispensing or exit region of the dunnage machine, away from the fixed point 228 and blade 202 to provide torque for a user of the cutter 200 operating the cutter. The forward location also provides easy access to an operator while cutting dunnage. Furthermore, it is noted that the surface 230 can be planar and/or horizontally aligned to provide an expansive area upon which an operator can place weight when making a cut to absorb maximum force at a reduced pressure on the surface of an operator's body. In some embodiments of the present disclosure, the surface 230 is padded to further reduce wear on the operator.

Figure 11:
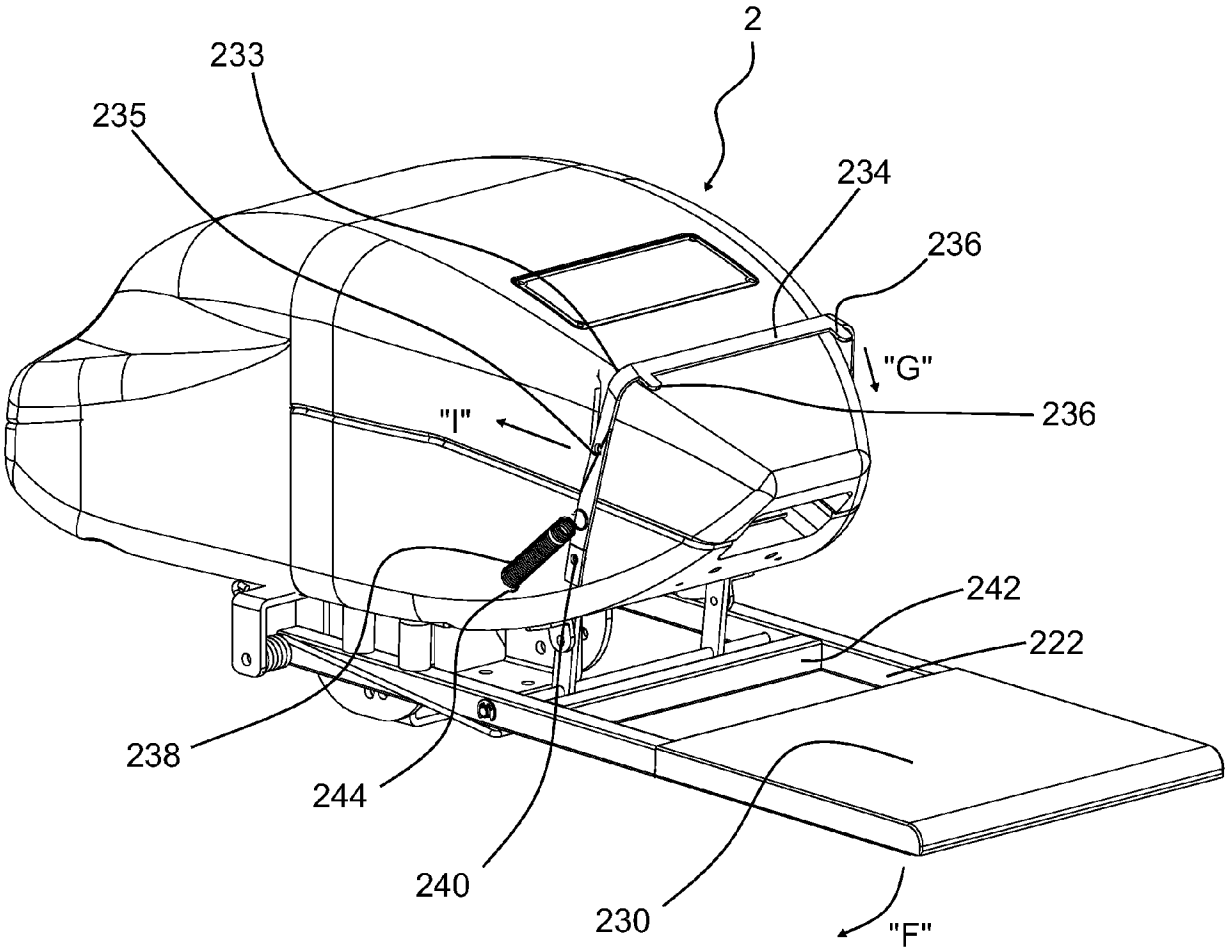
FIG. 11 is a perspective view of the dunnage machine of FIG. 1A, further comprising a cutter lock placed in an unlocked position, with a catch member of the cutter lock disposed in a lifted position above a top cover of the dunnage machine.
Figure 12:
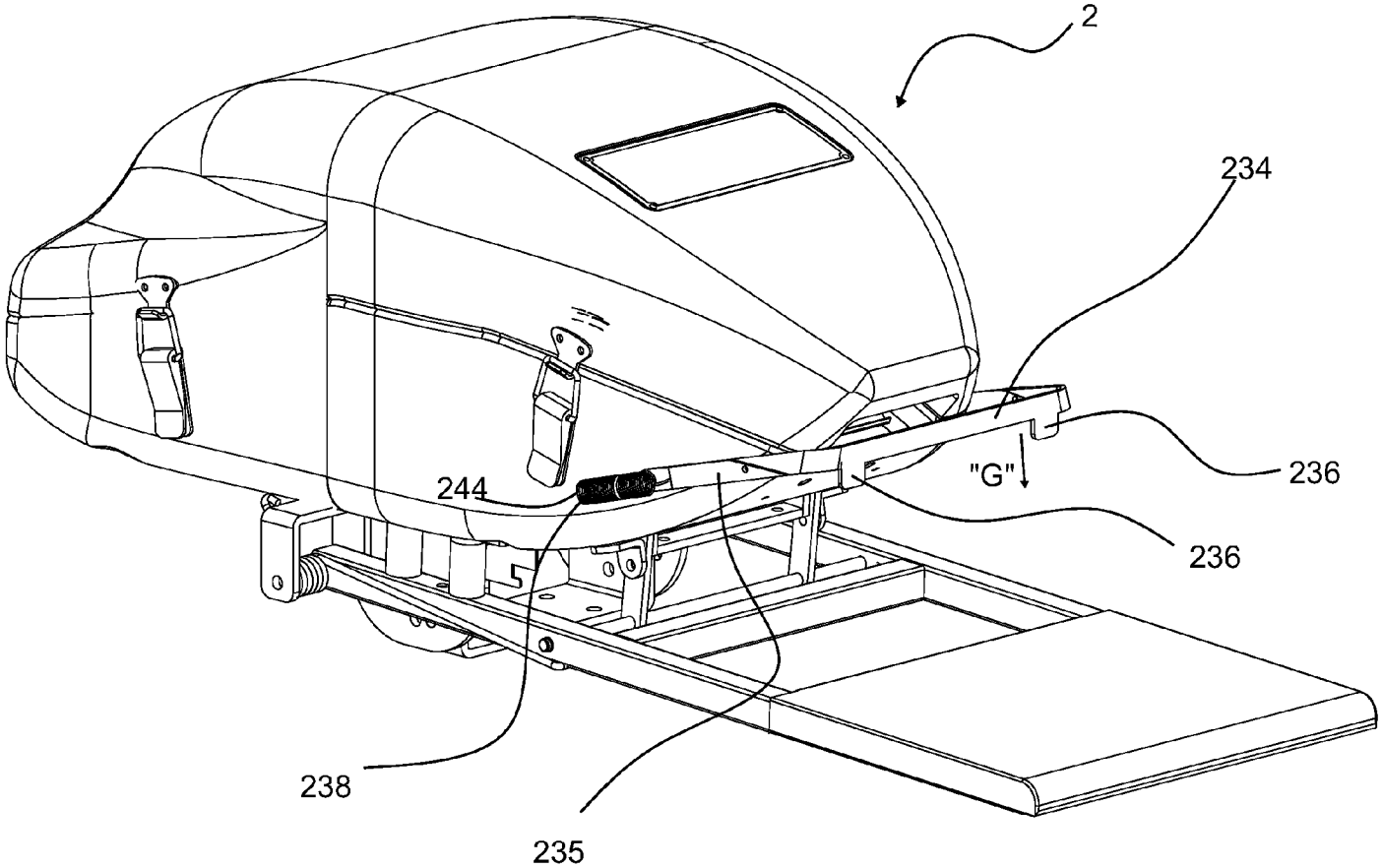
FIG. 12 is a perspective view of the dunnage machine of FIG. 11, with the catch member disposed in an initial clearance position.
Figure 13:
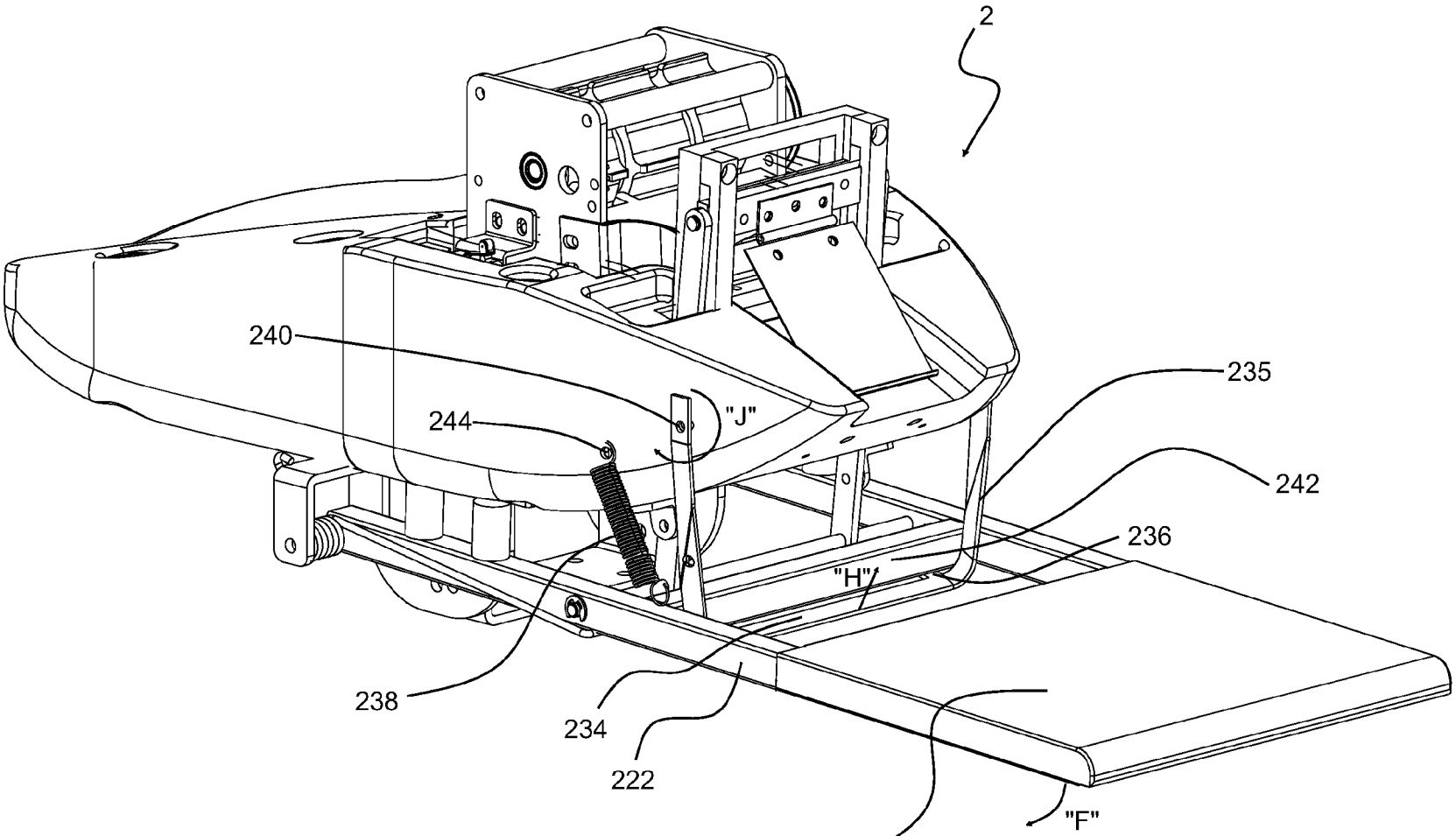
FIG. 13 is a perspective view of the dunnage machine of FIG. 11, with the cutter lock placed in a locked position wherein the catch member is disposed in a lowered position and catch tabs are disposed beneath a cross bar that is fixedly attached to elongated frame members of the cutter.

As best seen in FIGS. 11-13, in some embodiments of the present invention, a cutter lock 233 is provided having a catch member 234, which can be a rigid lateral member, such as a horizontally disposed bar or strip, and a pair of pivot arms 235 connected to the catch member 234. Each end portion of the catch member 234 is connected to a first end portion of one of the pivot arms 235. Each second end portion of each pivot arm 235 is, in turn, pivotably connected to a separate pivot point 240 on, for example, a bottom cover of the dunnage machine 2. A pair of catch tabs 236 extend outward from the catch member 234 at spaced apart locations on the catch member 234. The catch tabs 236 extend away from the catch member 234 in generally perpendicular fashion with respect to the pivot arms 235, or in an axis perpendicular to an axis of the pivot arms 235. In a related embodiment, the catch member 234 may have one, two or more catch tabs 236. In still another embodiment, the one or more catch tabs 236 may be located in another location on the dunnage machine 2, such as the cross bar 242.

In some embodiments of the present disclosure, the cutter lock 233 can be placed in an unlocked position by manually pivoting the pivot arms 235 until the catch member 234 is positioned snugly above a top cover of the dunnage machine 2, as shown in FIG. 11. In that unlocked position, the catch member 234 can prevent the top cover of the dunnage machine 2 from being lifted since it is disposed snugly against an upper surface of the top cover of the dunnage machine 2 and provides resistance against an upward three because the ends of the catch member 234 are connected to the pivot arms 235. In an unlocked position, the pivot arms 235 can be oriented substantially vertically or in a position sufficient to place the catch member 234 in a position to prevent the top cover of the dunnage machine 2 from being lifted or opened. A pair of coil springs 238 can each be fixedly attached to the bottom cover of the dunnage machine 2, with each coil spring 238 also having an opposite end connected to a proximate end portion of one of the pivot arms 235. In the unlocked position, the coil springs 238 can bias the catch member 234 against the top cover of the dunnage machine.

As can be seen in FIGS. 11, 12 & 13, the catch member 234 can be moved downward generally in the direction of arrow "G," by pivoting the pivot arms 235 about the pivot points 240 generally in the direction of arrow "J" (See, e.g., FIG. 13). The catch member 234 can thus be moved to an initial clearance position in which it initially clears a surface of the top cover of the dunnage machine 2, as shown in FIG. 12. When the catch member 234 reaches the initial clearance position, the coil springs 238 are generally longitudinally aligned with the pivot arms 235. Prior to the initial clearance position, the pivot arms 235 are raised, with the catch member 234 positioned above a surface of the top cover of the dunnage machine (See, e.g., FIG. 11). When the pivot arms 235 are raised, the coil springs 238 are positioned at an angle relative to the pivot arms (rather than being longitudinally aligned with the pivot arms 235), and are positioned on a generally upward facing side of the pivot arms 235, with the coil springs 238 biasing (e.g., pulling) the pivot arms backward, generally in the direction of arrow "I," to hold the pivot arms 235 up and to hold the catch member 234 against the top cover of the dunnage machine. When the catch member 234 clears the initial clearance position illustrated in FIG. 12 (wherein the coil springs 238 are longitudinally aligned with the pivot arms 235), and is moved further in the direction of arrow "G," the position of the coil springs 238 with respect to the pivot arms 235 changes to a downward facing side of the pivot arms 235 (See, e.g., FIG. 13), and coil springs 238 are again disposed at an angle with respect to the pivot arms 235, biasing (e.g., pulling) the pivot arms 235 downward and back.

A cross bar 242 extends between opposite elongated frame members 222 and is fixedly attached to the elongated frame members 222. As the pivot arms 235 are rotated downward (such as generally in the direction of arrow "J"), they eventually abut against the cross bar 242 as shown in FIG. 13. When the pivot arms 235 abut against the cross bar 242, the catch tabs 236 (shown in FIG. 11) tuck beneath or insert into or attach to the cross bar 242, to lock the cutter 200. That is, for example, the catch member 234 is in a locked position when the catch tabs 236 block (or lock) the elongated frame members 222 of the cutter 200 from being rotated downward in the direction of arrow "F," such that the cutter arms 216 cannot descend to putt the blade 202 downward. As noted above, other embodiments include one or more catch tabs on the cross bar 242 instead of the catch member, or one or more catch tabs on both the catch member and on the cross bar 242.

In some embodiments of the present disclosure, methods of preventing the cutter 200 from being actuated during maintenance of the dunnage machine 2 are also provided. For example, when a top cover of the dunnage machine 2 is secured to the dunnage machine, a user can manually move the catch member 234 from the position shown in FIG. 13, to the position shown in FIG. 11, wherein the catch member 234 is positioned above the top cover of the dunnage machine 2, and the coil springs 238 pull the pivot arms 235 in the direction of arrow "I," to secure the catch member 234 in place above the top cover. The top cover of the dunnage machine 2 is blocked by the catch member 234 from being removed when the catch member 234 is positioned above the top cover. However, when a user desires to access an interior of the dunnage machine 2 to, for example, perform maintenance, the user can move the catch member 234 forward and downward in the direction of arrow "G," past the initial clearance position shown in FIG. 12, after which, the coil springs 238 pull or bias the pivot arms 235 in the direction of arrow "J" (shown in FIG. 13) until the pivot arms 235 abut against the cross bar 242, and catch tabs 236 come to rest beneath or inside or are attached to the cross bar 242, thus locking the cutter 200 by preventing the elongated frame members 222 from being rotated. Conversely, after the maintenance is complete, and the top cover of the dunnage machine is replaced, the user can again rotate the pivot arms 235 in the direction of arrow "H") to place the catch member 234 in its position above the top cover of the dunnage machine as shown in FIG. 11. When the catch member 234 is positioned above the top cover, the cutter 200 is again free to be operated.

Although specific embodiments and examples of this disclosure have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described devices, systems and methods can omit some elements or acts, can add other elements or acts, or can combine the elements or execute the acts in a different manner or order than that illustrated, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims

What is claimed is:

1. A dunnage machine comprising:

an inlet;

at least one forming member;

a blade attached to a slidable blade mount, the blade being disposed near an exit region of the plurality of forming members;

at least one elongated frame member connected to the slidable blade mount, the at least one elongated frame member being pivotably connected to a fixed point relative to the dunnage machine;

a handle biasing member connected to a first end portion of the at least one elongated frame member;

a handle surface disposed near a second end portion of the at least one elongated frame member, wherein when the handle surface is depressed, the blade descends, and wherein when the handle surface is not depressed, the handle biasing member biases the at least one elongated frame member upward causing the blade to ascend;

at least one pivot arm;

at least one catch member connected to the at least one pivot arm; and at least one biasing member connected to the at least one pivot arm, wherein when the at least one pivot arm is pivoted to a downward position, the at least one biasing member biases the at least one catch member toward a cross member that is attached to the at least one elongated frame member to couple the at least one catch member with the cross member and prevent the at least one elongated frame member from being moved, and wherein when the at least one pivot arm is pivoted to an upward position, the at least one biasing member biases the at least one catch member against a cover of the dunnage machine.

2. The dunnage machine of claim 1 wherein when the at least one catch member is biased against the cover of the dunnage machine, it is biased against an upper surface of the cover of the dunnage machine.

3. The dunnage machine of claim 1 wherein when the at least one catch member is coupled with the cross member, at least one catch tab extending from the catch member tucks beneath the cross member.

4. The dunnage machine of claim 1 wherein the at least one biasing member is a coil spring.

5. The dunnage machine of claim 4 wherein the coil spring is connected at one end portion to a fixed position relative to the dunnage machine and at another end portion to the at least one pivot arm.

6. The dunnage machine of claim 5 wherein when the when the at least one pivot arm is pivoted to an upward position, the coil spring is disposed on a generally upward facing side of the at least one pivot arm.

7. The dunnage machine of claim 5 wherein when the when the at least one pivot arm is pivoted to a downward position, the coil spring is disposed on a generally downward facing side of the at least one pivot arm.

8. A dunnage machine comprising:

an inlet;

at least one forming member;

a blade attached to a slidable blade mount, the blade being disposed near an exit region of the at least one forming member;

at least one elongated frame member connected to the slidable blade mount, the elongated frame member being pivotably connected to a fixed point relative to the dunnage machine;

at least one biasing member connected to the at least one elongated frame member, the at least one elongated frame member having a first end portion;

at least one handle surface disposed near a second end portion of the at least one elongated frame member, wherein when the at least one handle surface is depressed, the blade descends, and wherein when the at least one handle surface is not depressed, the at least one biasing member biases the at least one elongated frame member upward causing the blade to ascend; and wherein when the at least one handle surface is not depressed, at least a portion of the at least one handle surface is disposed forward of the exit region of the dunnage machine in a resting position.

9. The dunnage machine of claim 8 wherein the at least one handle surface is planar.

10. The dunnage machine of claim 8 wherein a plane of the at least one handle surface is horizontally aligned.

11. The dunnage machine of claim 8 wherein the at least one handle surface is at least four times wider than a maximum diameter of the elongated frame member.

12. The dunnage machine of claim 8 wherein the second end portion of the at least one elongated frame member is disposed forward of the exit region of the dunnage machine in a resting position when the at least one handle surface is not depressed.

13. The dunnage machine of claim 8 further comprising at least one cutter arm connected to the slidable blade mount, the at least one cutter arm also being pivotably connected to at least one lateral bar, the at least one lateral bar being connected to the at least one elongated frame member.

14. The dunnage machine of claim 13 wherein the at least one cutter arm is pivotably connected to the at least one lateral bar at a bottom end portion of the at least one cutter arm, and wherein the at least one cutter arm is pivotably connected to at least one slider bar at a top end portion of the at least one cutter arm.

15. The dunnage machine of claim 14 wherein the slidable blade mount is connected to the at least one slider bar.

* * * * *

UNITED STATES PATENT AND TRADEMARK OFFICE

CERTIFICATE OF CORRECTION

PATENT NO. : 8,708,882 B2
APPLICATION NO. : 13/107857
DATED : April 29, 2014
INVENTOR(S) : Chan et al.

It is certified that error appears in the above-identified patent and that said Letters Patent is hereby corrected as shown below:

In the Claims

Claim 1, Column 8, lines 48-50, delete "a blade attached to a slidable blade mount, the blade being disposed near an exit region of the plurality of forming members;" and insert --a blade attached to a slidable blade mount, the blade being disposed near an exit region of the at least one forming member.--

Claim 6, Column 9, lines 24-25, delete "The dunnage machine of claim 5 wherein when the when the at least one pivot arm is pivoted to an upward position..." and insert --The dunnage machine of claim 5 wherein when the at least one pivot arm is pivoted to an upward position...--

Claim 7, Column 9, lines 28-29, delete "The dunnage machine of claim 5 wherein when the when the at least one pivot arm is pivoted to a downward position..." and insert --The dunnage machine of claim 5 wherein when the at least one pivot arm is pivoted to a downward position...--

Signed and Sealed this
Fourteenth Day of October, 2014

Michelle K. Lee

Michelle K. Lee
*Deputy Director of the United States Patent and Trademark Office*